US006030192A

United States Patent [19]

Hill et al.

[11] Patent Number: 6,030,192

[45] Date of Patent: Feb. 29, 2000

[54] SCROLL COMPRESSOR HAVING BEARING STRUCTURE IN THE ORBITING SCROLL TO ELIMINATE TIPPING FORCES

[75] Inventors: Joe T. Hill, Bristol, Va.; Gene M. Fields; John R. Williams, both of Bristol, Tenn.; Terry L. Lyons, Bluff City, Tenn.

[73] Assignee: Bristol Compressors, Inc., Bristol, Va.

[21] Appl. No.: 08/979,878

[22] Filed: Nov. 26, 1997

Related U.S. Application Data

[63] Continuation of application No. 08/643,199, May 6, 1996, abandoned, and a continuation of application No. 08/364,342, Dec. 23, 1994, abandoned.

[51] Int. Cl.[7] ..... F04C 18/04

[52] U.S. Cl. ..... 418/55.2; 418/55.4; 418/55.5; 418/57

[58] Field of Search ..... 418/55.1, 55.2, 418/55.4, 55.5, 57

[56] References Cited

U.S. PATENT DOCUMENTS

| | | | |
|---|---|---|---|
| 4,303,379 | 12/1981 | Hiraga et al. | 418/55.2 |
| 5,098,265 | 3/1992 | Machida et al. | 418/55.2 |
| 5,129,798 | 7/1992 | Crum et al. | 418/55.4 |
| 5,152,682 | 10/1992 | Morozumi et al. | 418/55.1 |
| 5,304,047 | 4/1994 | Shibamoto | 418/55.2 |

FOREIGN PATENT DOCUMENTS

| | | | |
|---|---|---|---|
| 5728890 | 2/1982 | Japan | 418/55.4 |
| 4101089 | 4/1992 | Japan | 418/55.1 |
| 4311691 | 11/1992 | Japan | 418/55.5 |
| 5-5485 | 1/1993 | Japan | 418/55.2 |
| 5157063 | 6/1993 | Japan | 418/55.5 |

*Primary Examiner*—John J. Vrablik
*Attorney, Agent, or Firm*—Howard & Howard

[57] ABSTRACT

A scroll compressor having a housing containing an orbiting scroll and a non-orbiting scroll each having a base formed with a free side and a compression side and having an involute extending generally normally from the compression side, each the involute terminating in an axially outer, substantially planar edge and having a radially outer inlet end and a radially inner discharge end, the scrolls being mounted within the housing in mating arrangement about a center axis of the involutes for relative orbital motion for compressing gas between the base and adjacent side portions of the involutes, the orbiting scroll having special bearing structure for eliminating the laterally directed tipping forces which are generally experienced by the orbiting scrolls of conventional scroll compressors, the bearing structure having a bearing hub integral with the discharge end of the involute of the orbiting scroll, the hub having a cylindrical bore oriented substantially normal to the compression side of the orbiting scroll for rotatably receiving an eccentric shaft section of a compressor crankshaft, bearing means formed axially thru the base of the non-orbiting scroll, a crankshaft having an axial section and an eccentric section, the axial section being rotatably mounted in the bearing and the eccentric section being rotatably mounted in the hub, whereby rotation of the crankshaft will move the orbiting scroll thru an orbit relative to the non-orbiting scroll to thereby generate compression pockets between both the base and the involutes.

11 Claims, 7 Drawing Sheets

SCROLL COMPRESSOR HAVING BEARING STRUCTURE IN THE ORBITING SCROLL TO ELIMINATE TIPPING FORCES

This application is a continuation of Ser. No. 08/643,199, filed May 6, 1996, and now abandoned, and a continuation of Ser. No. 08/364,342, filed Dec. 23, 1994, abandoned.

FIELD OF INVENTION

This invention concerns scroll compressors and particularly concerns novel structure of the scrolls themselves.

BACKGROUND OF THE INVENTION

In scroll compressors, the high pressure pockets are typically responsible for imparting strong forces, i.e., tangential radial, or lateral against the wrap of the orbiting scroll which tend to tip the scroll on its longitudinal axis. This tipping usually results in loss of sealing between the scrolls and thus a loss of efficiency, as well as excessive wear contact of the orbiting scroll with the stationary scroll, and also requires more axial compliance force to compensate for the non-planar mating of the wraps outer edges with the bases of the other scroll. The present invention dramatically diminishes or even eliminates the tendency of the orbiting scroll to so tip.

PRIOR ART

Heretofore, scroll compressors, whether of the simple orbiting type or the complex co-rotational type have utilized orbiting scrolls which are constructed such that their wraps or involutes are axially displaced along the longitudinal axis of the compressor from the eccentric of the drive shaft, which eccentric drives the orbiting scroll thru its orbiting motion with respect to the non-orbiting scroll. This prior construction necessarily lends itself to tipping of the orbiting scroll on said longitudinal axis by the aforesaid forces which are generated by compression between the wraps. Such prior scroll construction is typified by U.S. Pat. Nos.: 4,121,438; 5,129,798; 5,017,107; 4,609,334; 4,877,382; 5,102,316; 5,088,906; 4,938,669; 4,938,609; 5,085,565; 5,082,432; 4,892,469; and 4,884,985, the disclosures of which regarding the known and generally employed construction of compressor shell, motor, Oldham coupling, aspects of scroll construction and manufacture auxiliary to or other than that of the present invention, scroll drive structure, and the like, are hereby incorporated herein by reference, as being useful in manufacturing and/or use of the present invention.

Objects, therefore, of the present invention are: to provide scroll construction which substantially eliminates the development of net or unbalanced compression forces which normally would cause tipping of the orbiting scroll, i.e., across its longitudinal axis and which would necessitate the application of higher axial compliance forces; to provide such construction which eliminates the need for ancillary axial motion guide means for maintaining the radial position of the axially movable scroll during axial compliance; to provide such construction which minimizes the degree of scroll modification necessary for utilizing the present invention; to provide such construction which essentially maintains the compression efficiency of the scrolls; to provide such scroll construction which is adaptable to a wide variety of scroll compressor constructions; to provide a scroll arrangement with respect to discharge porting whereby regulation of axial compliance forces are facilitated; and structural simplification is achieved to provide such construction which minimizes any necessary increase in wrap length due to enlarged start angle; and to provide such construction with unique improvements in scroll area lubrication mechanism.

BRIEF SUMMARY OF THE INVENTION

These and further objects hereinafter appearing have been attained in accordance with the present invention which, in a preferred embodiment is defined as a scroll compressor having housing means containing an orbiting scroll and a non-orbiting scroll each having a base means formed with a free side and a compression side and having an involute extending generally normally from said compression side, each said involute terminating in an axially outer, substantially planar edge and having a radially outer, low pressure refrigerant inlet end and a radially inner, high pressure refrigerant discharge end, said scrolls being mounted within said housing in mating arrangement about a center axis of said involutes, guide means associated with said scrolls for restricting relative motion therebetween to an orbital motion which acts to compress gas between said base means and adjacent side portions of said involutes, said mating arrangement forming inlet port means adjacent each said inlet end of said involutes, discharge port means formed thru one of said base means adjacent said discharge ends of said involutes and communicating therewith, low pressure refrigerant inlet means formed thru said housing means and communicating with said inlet port means, high pressure refrigerant discharge outlet means formed thru said housing means and communicating with said discharge port means, said orbiting scroll having special bearing structure for eliminating the tipping moment which is generally experienced by the orbiting scrolls of conventional scroll compressors, said bearing structure comprising bearing hub means integral with the discharge end of said involute of said orbiting scroll, said hub means having cylindrical bore means oriented substantially normally to said compression side of said orbiting scroll for rotatably receiving an eccentric shaft section of a compressor crankshaft, bearing means formed axially thru said base means of said non-orbiting scroll, crankshaft means having an axial section and an eccentric section, said axial section being rotatably mounted in said bearing means and said eccentric section being rotatably mounted in said bore means of said hub means, whereby rotation of said crankshaft means in cooperation with said guide means will move said orbiting scroll thru an orbit relative to said non-orbiting scroll to thereby generate compression pockets between said base means and said involutes, which pockets progressively diminishes in volume and increase in pressure as they are moved along said involutes from said inlet ends to said discharge ends thereof.

In certain preferred embodiments:

(a) the bore of said hub means extends from adjacent the plane of said compression side of said base means of said orbiting scroll to adjacent the plane of said planar edge of said involute of said orbiting scroll such that the longitudinal mid-point of said eccentric shaft section is substantially coextensive with the center axis of said involutes, which construction results in substantially complete cancellation of the net forces which tend to tip the scroll on its longitudinal axis;

(b) reducing the package size of the scroll set and the start angle by utilizing a radial offset between the center axis of the orbiting involute and the longitudinal axis of the hub bore;

(c) a delineated portion of the discharge side of the base means of said orbiting scroll is coextensive with high pressure discharge chamber means of the compressor whereby pressure responsive means is built into the compressor structure for generating specifically selected axial compliance forces;

(d) a large central area of the free side of the base means of the orbiting scroll is coextensive with pressure chamber means which is defined and controllably sealed by means of the combination of said free side, a stationary portion of the compressor such as a wall or end cap of the housing thereof, and an annular resilient seal surrounding and delimiting the periphery of said chamber means and sealing contacting adjacent surfaces of said stationary portion and said free side, and wherein said chamber means is in communication by passage means with intermediate pressure developed by said scrolls;

(e) the annular seal of (d) is radially inwardly substantially concave as defined by an intermediate portion provided with two oppositely disposed axially flared sides, one of which sides is in resilient sealing contact with said surface of said stationary portion and the other of which sides is in resilient sealing contact with surface of said free side;

(f) the annular seal of (d) delimits the area of said chamber means to greater than about one half of the total area of said free side; and (g) the base of the stationary scroll lies intermediate the scroll compression discharge area and the electric motor area and is provided with high pressure discharge port means which places said discharge area and motor area in fluid communication.

BRIEF DESCRIPTION OF THE DRAWINGS

The invention will be further understood from the drawings herein of preferred embodiments, and the descriptions thereof, wherein equivalent structures are numbered the same in the various figures.

Figure 1:
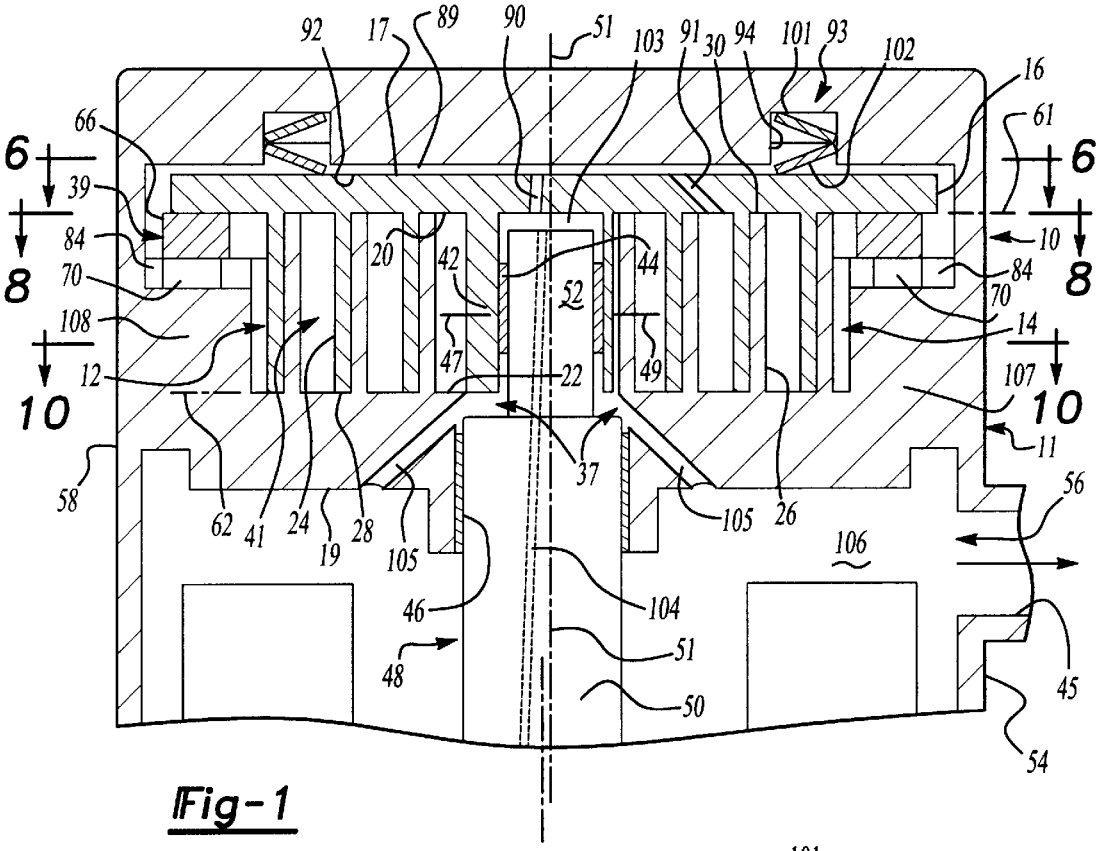
FIG. 1 is a longitudinal cross-sectional view of the scroll section of a compressor embodying the present invention in preferred form wherein the center axis of the involutes and the longitudinal axis of the crankshaft eccentric are offset.

Referring to the drawings and with particular reference to the claims hereof, the present scroll compressor comprises housing means generally designated 10 containing an orbiting scroll generally designated 12 and a stationary or non-orbiting scroll generally designated 14, each having a base means 16, 18 respectively, each formed with a free side 17, 19 respectively, a compression side 20, 22 respectively and an involute or wrap 24, 26 respectively extending generally normally from said compression side of its base and each terminating in an axially outer, substantially planar edge 28, 30 respectively and each having a radially outer inlet end 32, 34 respectively and a radially inner discharge end 36, 38 respectively, said scrolls being mounted within said housing in mating arrangement about a center axis 40 of said involutes, guide means generally designated 39 associated with said scrolls for restricting relative motion therebetween to an orbital motion which acts to compress gas between both said base means and adjacent side portions of said involutes, said mating arrangement forming inlet port means 33, 35 respectively adjacent each said inlet end of said involutes, discharge port means 37 formed thru at least one of said base means adjacent said discharge ends of said involutes and communicating therewith, low pressure refrigerant inlet means 43 formed thru said housing means and communicating with said inlet port means 33, 35, high pressure refrigerant discharge outlet means 45 formed thru said housing means and communicating with said discharge port means 37, said orbiting scroll having special bearing structure for eliminating the tipping forces generally designated 41 which are generally experienced by the orbiting scrolls of conventional scroll compressors, said bearing structure comprising bearing hub means 42 formed by a continuation segment 31 integral with the discharge end of said involute of said orbiting scroll, said hub means having cylindrical bore means 44 oriented substantially normally to said compression side 20 of said orbiting scroll for rotatably receiving an eccentric shaft section of a compressor crankshaft, bearing means 46 formed axially thru said base means 19 of said non-orbiting scroll, crankshaft means 48 having an axial section 50 and an eccentric section 52, said axial section being rotatably mounted in said bore means of said bearing means and said eccentric section being rotatably mounted in said bore means 44 of said hub means, whereby rotation of said crankshaft means in cooperation with said guide means will move said orbiting scroll thru an orbit relative to said non-orbiting scroll to thereby generate compression pockets between both said base means and said involutes, which pockets progressively decrease in volume and increase in pressure as they are moved along said involutes from said inlet ends to said discharge ends thereof.

The housing means 10, is shown in a simplistic but completely operable form and comprises a shell generally designated 11 which may be of the typical welded upper and lower halves construction and having a crankcase (not shown) providing the oil sump and lower shaft bearings in conventional manner, a mid-section 54 containing the electric motor 56, and an upper or compression section 58 containing the scrolls 12, 14, drive shaft eccentric 52, inlet plenum 60, guide means 39, e.g., an Oldham coupling ring and annular shaped orbiting scroll seal 93.

Figure 6:
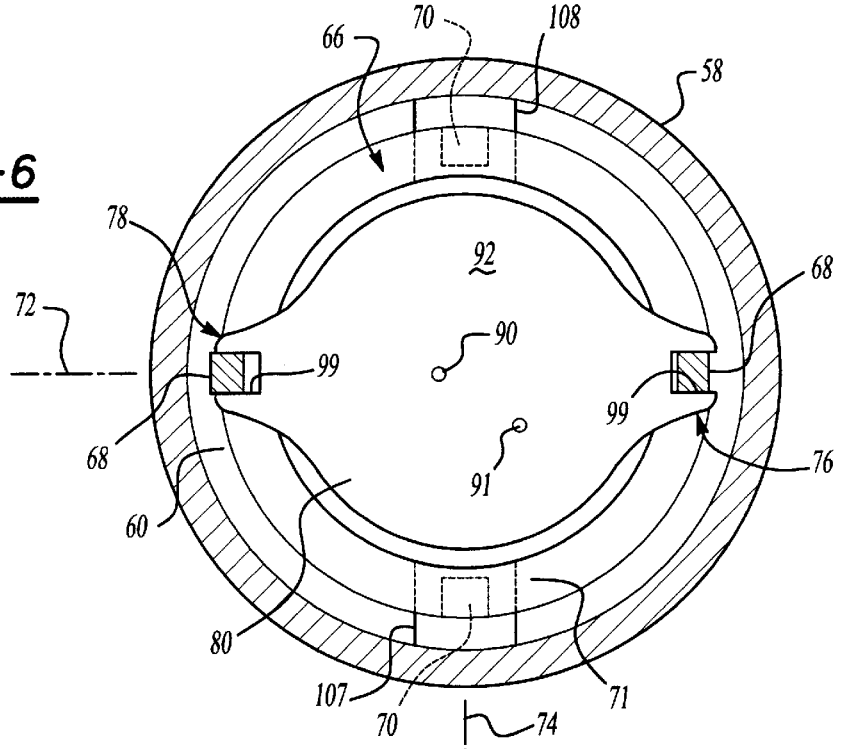
FIG. 6 is a top, cross-sectional view of the compressor of FIG. 2 taken along line 6—6 thereof in the direction of the arrows with structural portions broken away for clarity.
Figure 7:
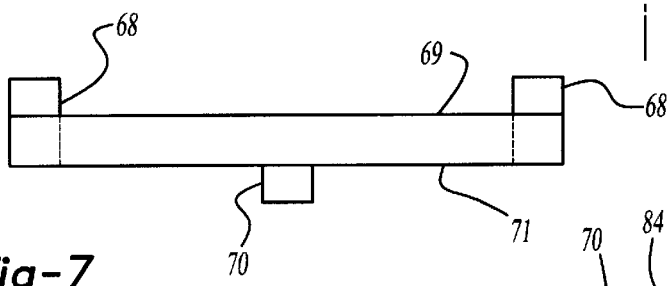
FIG. 7 is a side elevational view of an Oldham coupling ring which can be employed in practicing the present invention.
Figure 8:
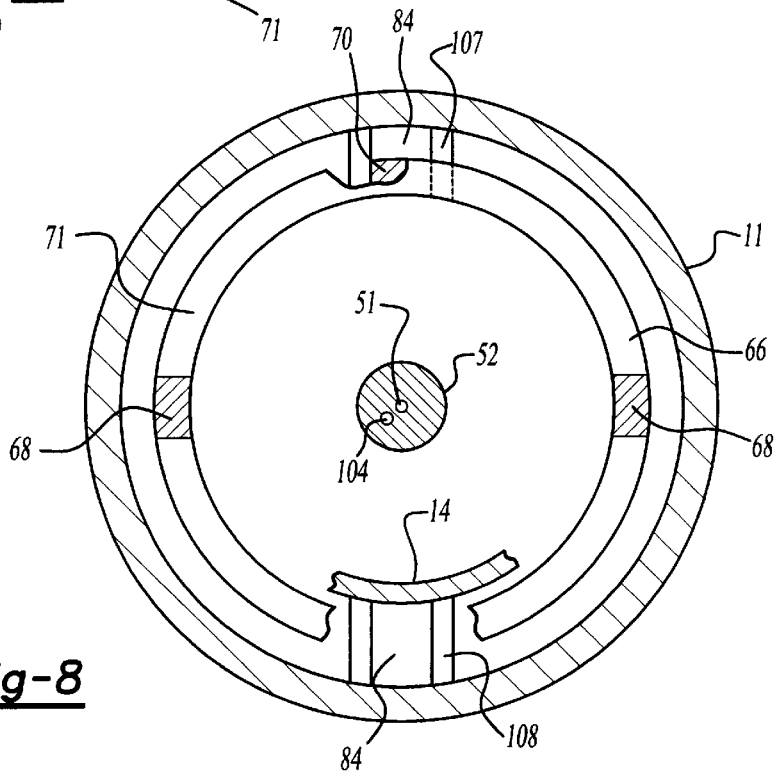
FIG. 8 is a cross-sectional view taken along line 8—8 of FIG. 1 in the direction of the arrows with portions broken away for clarity.

The guide means 39 preferably is of the Oldham coupling type typically employed for maintaining the motion of the orbiting scroll and its involute to a small circular orbit with respect to the fixed or non-orbiting scroll and its involute. A first part of this coupling, as shown most clearly in FIGS. 6–8 comprises a ring 66 and two key lugs pairs 68 and 70. The actual configuration of the ring can be varied as desired and typically is custom tailored, i.e., to accommodate the compressor shell and scroll base dimensions and configurations, and the clearance between the shell and the orbiting scroll. The configuration of ring 66 as shown is exemplary only. The lugs 68 are formed on one side 69 of the ring and lugs 70 are formed on the other side 71 thereof along axes 72 and 74 respectively which are at right angles to each other. The orbiting scroll 12 is provided with two ear sets 76 and 78 which provide slots at 99 to slidably receive the lugs 68 of the Oldham ring as shown and in known manner. The second part of this coupling also shown in these figures comprise a pair of stanchions 107 and 108 oppositely disposed on the inside of shell 11 and preferably integrally formed therewith, and provided with slots 84 in which lugs 70 slide.

In the embodiment shown in FIGS. 12–15, the upper wall or plate 80 within the housing 10, which wall, in association with base means 18 and the inner surface 82 of shell 11 define the aforesaid refrigerant inlet or suction plenum 60, is provided on its underside 95 with a pair of slots 84 for slidably receiving key lugs 70 of ring 66. Plate 80 is provided with central aperture 96 opening into discharge plenum 97 which is in gas flow communication with outlet 45 through passage 98 formed, e.g., in shell 11. This construction provides for gas flow over and around motor 56 for cooling the same. It is noted that for all of the embodiments and variations shown herein, shell 11 can constructed, e.g., in sections which are provided with bolted flanges or the like, or which can be hermetically welded, whereby machining and assembly of the various parts can be readily accomplished. The Oldham ring reciprocates in a motion which is parallel to the slots and 84 containing the two pairs of key lugs and thus allows only orbital motion of the orbiting scroll relative to the fixed or non-orbiting scroll as more fully described in the aforesaid U.S. Pat. No. 4,121,438. Other known devices for controlling relative rotation or angular motion of the scrolls, such as the use of multiple drives rotating both scrolls about different centers, and like devices may also be used in practicing the present invention.

The bore 44 of said hub means having a longitudinal axis 51, extends preferably from adjacent the plane 61 of said compression side 20 of said base means of said orbiting scroll to adjacent the plane 62 of said planar edge 28 thereof. This bore can extend further up into base 16 by slightly relocating the discharge port conduits 37, however, the position shown is preferred as it not only places the longitudinal mid-point 47 of the eccentric section 52 lying within the hub in a coextensive position with respect to the longitudinal mid-point 49 of the involutes but also increases the bearing surface for the eccentric. This coextensive position reduces or completely eliminates the aforesaid tipping moment acting against the orbiting scroll. It is noted however, that for certain compressor constructions, it may be desirable to extend the eccentric only to about the mid-point 49 of the scrolls or slightly beyond in order to eliminate any tipping moment. An extension of the eccentric only part way upwardly toward mid-point 49 would give only partial cancellation of the tipping moment, which, for certain applications could be adequate.

Figure 10:
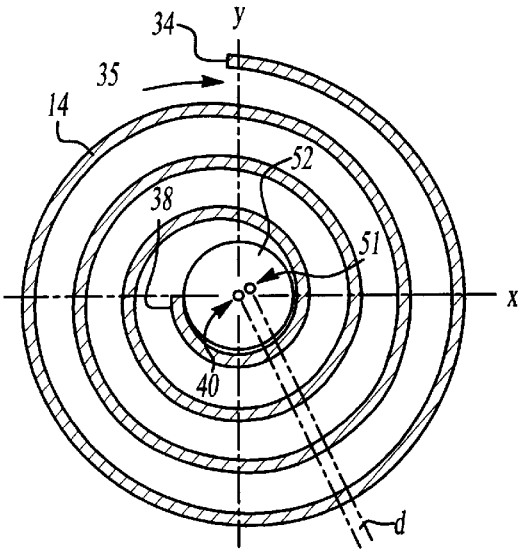
FIG. 10 is a cross-sectional view of the wrap of the stationary scroll taken along line 10—10 of FIG. 1 in the direction of the arrows.
Figure 11:
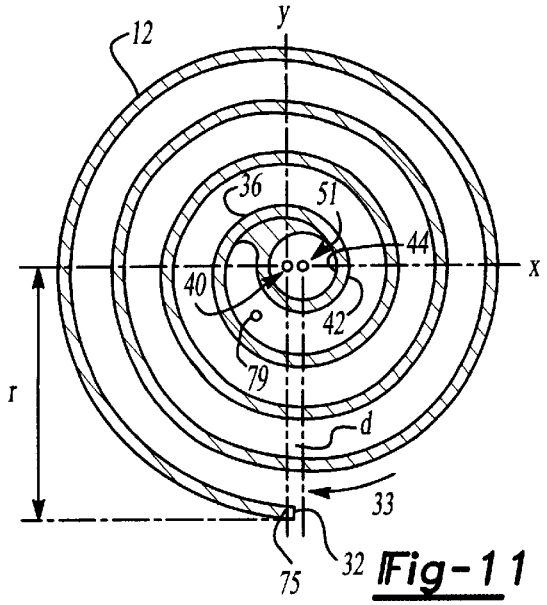
FIG. 11 is a cross-sectional view of the orbiting scroll wrap taken as for FIG. 10.
Figure 16:
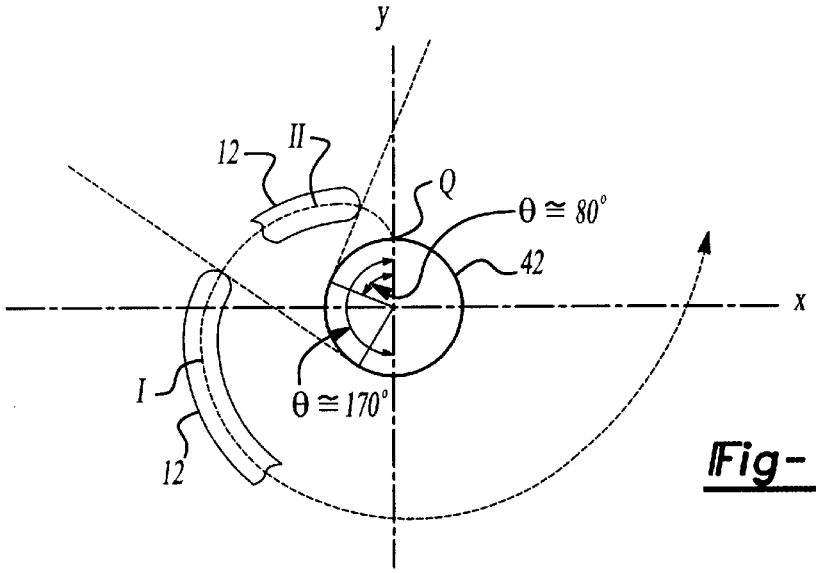
FIG. 16 is a depiction of the generation of the scroll wrap from two different start angles.

It is preferred for the various embodiments herein, that the center axis 40 of the involutes is radially offset from the axis 51 of the hub whereby the package size, particularly the diameter of the scroll set and the start angle θ of the involutes are decreased. This embodiment is described in detail in FIGS. 10, 11 and 16 wherein the said package diameter is the dimension "2r" wherein r is the length of the line extending from the center axis 40 of the orbiting scroll involute to the exterior surface 75 thereof. It is seen that as the longitudinal axis 51 of the hub bore, as well as the hub itself, are moved radially a small amount "d" between the positive x and y axes, the start angle θ for the start of the generation of the involute can be markedly reduced such that additional length of the involute adjacent its discharge end can be realized. In this regard, with reference to FIG. 16, for an involute design I, starting at point Q, a start angle θ of about 170° would give a 60,000 Btu, i.e., a 5 Ton scroll compressor having a volume ratio of 2.2, a scroll set diameter of about 4.86 in. For the same capacity and volume ratio scroll set, but with an involute design II evolved from a start angle θ of about 80°, the scroll set diameter would be reduced to about 4.05 in., a 16.6% reduction in scroll package size. It is noted that for the small start angle difference achievable with the displacement shown in FIG. 11, a substantial reduction in scroll set package size of several percent is realized.

The present design of the involute is made around the circle, i.e., generating radius defining the hub exterior 42 according to the following involute equations as follows:

1. WALL CENTERLINE $x=-Rg(\sin\theta-\theta\cos\theta)$ $y=Rg(\cos\theta+\theta\sin\theta)$

2. OUTSIDE WALL $x=-Rg(\sin\theta-\theta\cos\theta)+\frac{1}{2}t\cos\theta$ $y=Rg(\cos\theta+\theta\sin\theta)+\frac{1}{2}t\sin\theta$, wherein t is the involute wall thickness.

3. INSIDE WALL $x=-Rg(\sin\theta-\theta\cos\theta)-\frac{1}{2}t\cos\theta$ $y=Rg(\cos\theta+\theta\sin\theta)-\frac{1}{2}t\sin\theta$

4. PITCH $P=2\pi Rg$=CIRCUMFERENCE OF CIRCLE

5. ORBIT RADIUS $$R_0=\frac{P-2t}{2}=\pi Rg-t$$

Figure 9:
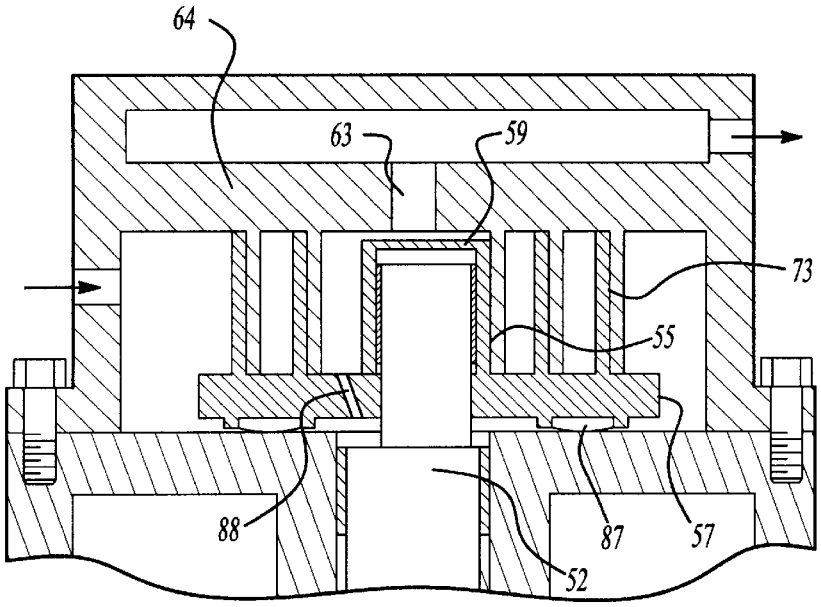
FIG. 9 is a cross-sectional view of a variation of the orbiting scroll wherein the hub means extends through the base thereof.

Referring to FIG. 9, an alternative structure and location for the bearing hub means is shown. In this embodiment, the hub means 55 is formed thru the base 57 of the orbiting scroll and is provided with a cap 59, the inner surface of which is sufficiently spaced from the end of eccentric section 52 of the crankshaft that the desired axial travel of the orbiting scroll upon excessive pressure development can occur. Discharge port 63 is provided in the base 64 of the non-orbiting scroll 73. An Oldham coupling type of guide is provided for this embodiment in any suitable manner equivalent to that shown for the orbiting scroll of FIG. 1, i.e., ring 66, lugs 68, 70, ears 76, 78 and slots 99 and 84.

Figure 12:
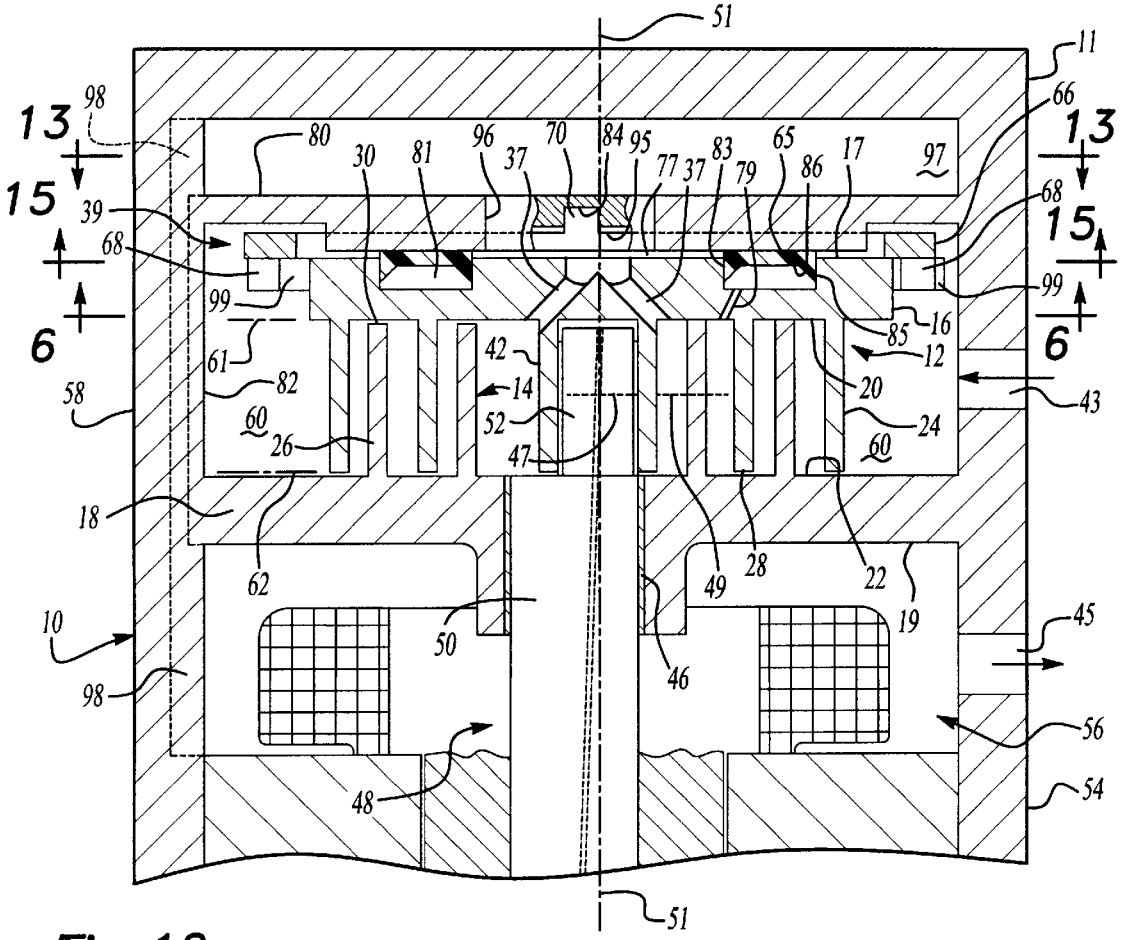
FIG. 12 is a longitudinal cross-sectional view of an alternative embodiment of the scroll section of the present compressor.
Figure 13:
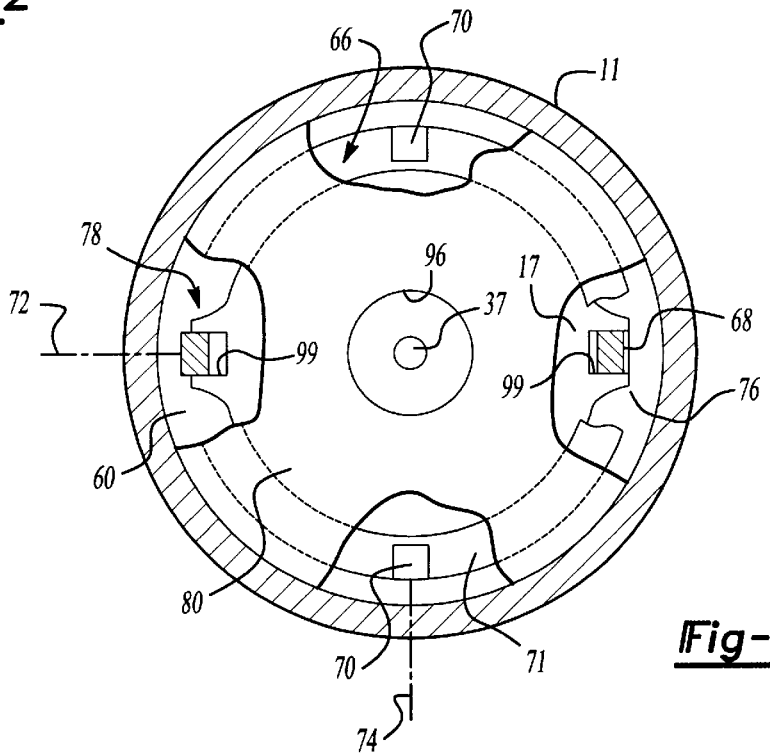
FIG. 13 is a top, cross-sectional view of the compressor of FIG. 12 taken along line 13—13 thereof in the direction of the arrows with structural portions thereof broken away for clarity.
Figure 14:
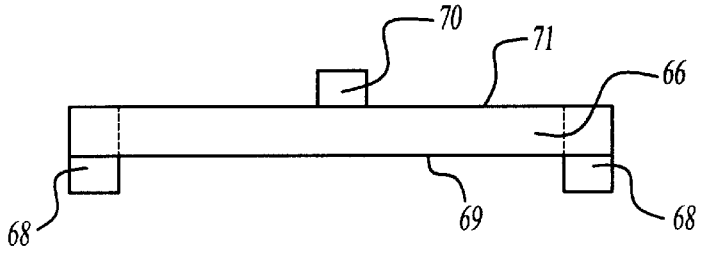
FIG. 14 is a side elevational view of an Oldham coupling ring which can be employed in practicing the present invention.
Figure 15:
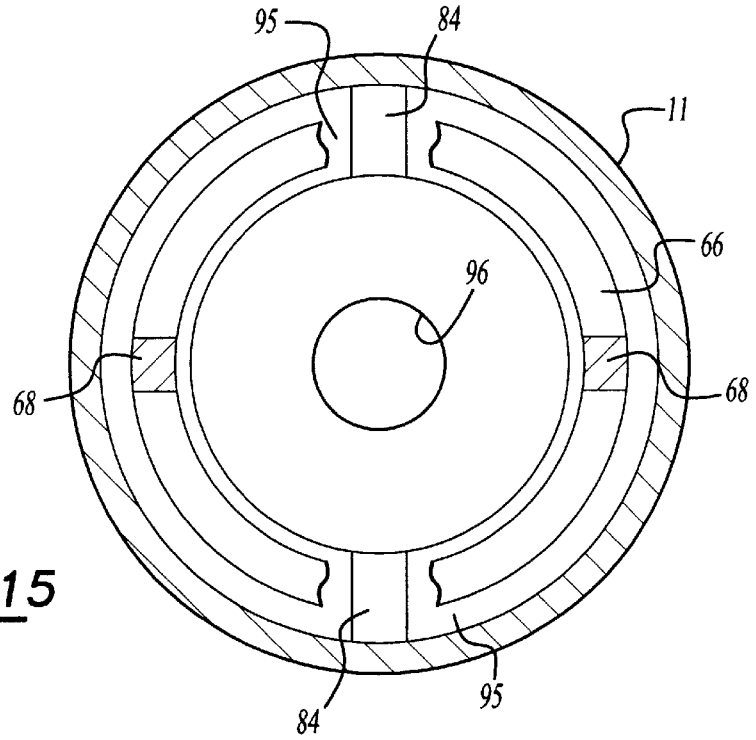
FIG. 15 is a cross-sectional view taken along line 15—15 of FIG. 12 in the direction of the arrows with portions broken away for clarity.

The axial compliance of the scrolls in the embodiment shown in FIG. 12 is achieved by applying full discharge gas pressure from discharge port means 37 to the surrounding free surface portion 77 of base means 16 and by separately applying intermediate gas pressure from conduit 79, which conduit interconnects the partially pressurized gas in the compression pocket of the scroll at a preselected position therein, to annular channel 81 formed into the free side of base means 16. An elastomeric type of annular seal 65 nesting in the channel is provided with flexible expandable sides 83, 85 which press outwardly against the sides of the channel and become sealed thereagainst by means of the intermediate gas pressure. This intermediate pressure also forces the web 86 of the seal against plate 80 and, in combination with the discharge pressure force against surface portion 77, urges the planar edge 28 of the orbiting scroll toward sealing contact with the base 18 of the non-orbiting scroll.

In the embodiment of FIG. 9, axial compliance may be achieved similarly by annular seal 87 and any number of intermediate gas pressure conduits such as 88 to overcome the discharge gas pressure which is felt against the end 59 of the hub.

Figure 2:
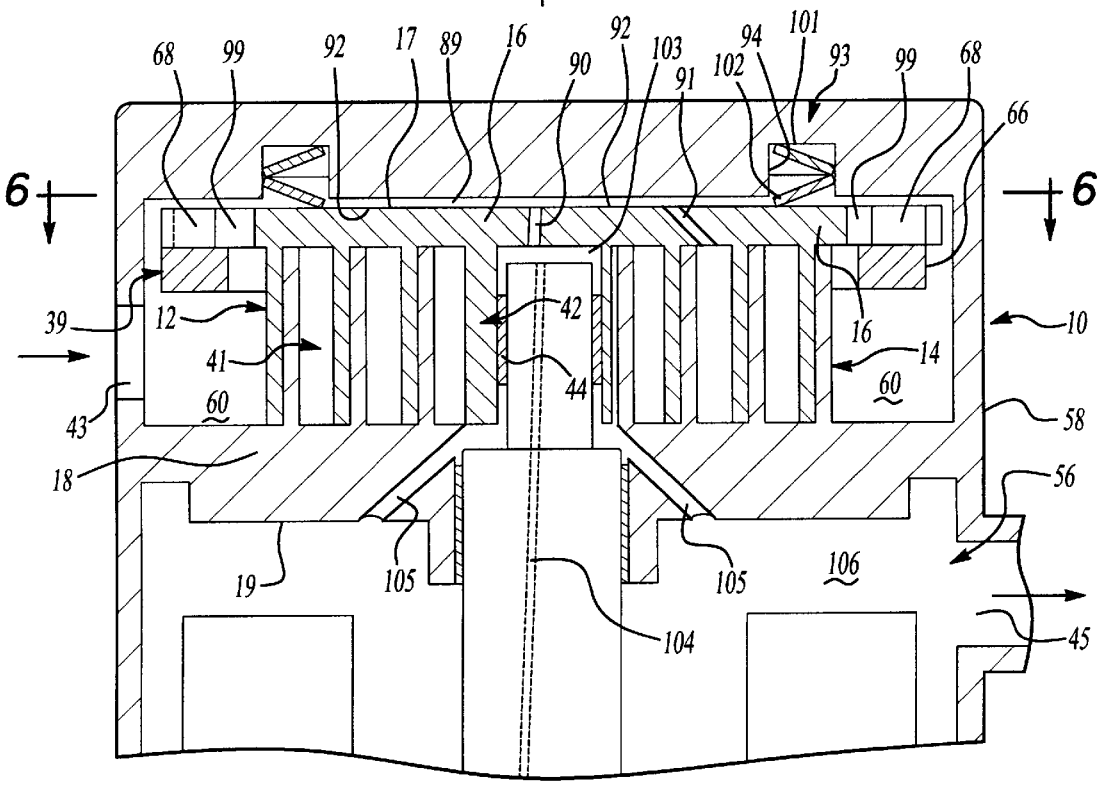
FIG. 2 is a view as in FIG. 1 rotated 90° about the longitudinal axis of the compressor.
Figure 3:
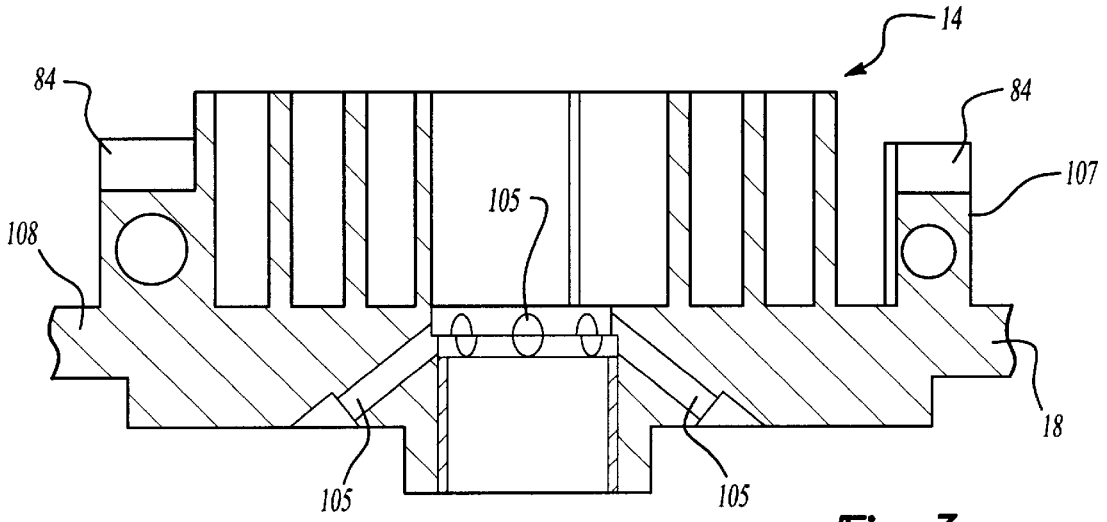
FIG. 3 is a longitudinal cross-sectional view of a preferred structure for the non-orbiting scroll of FIG. 1.
Figure 4:
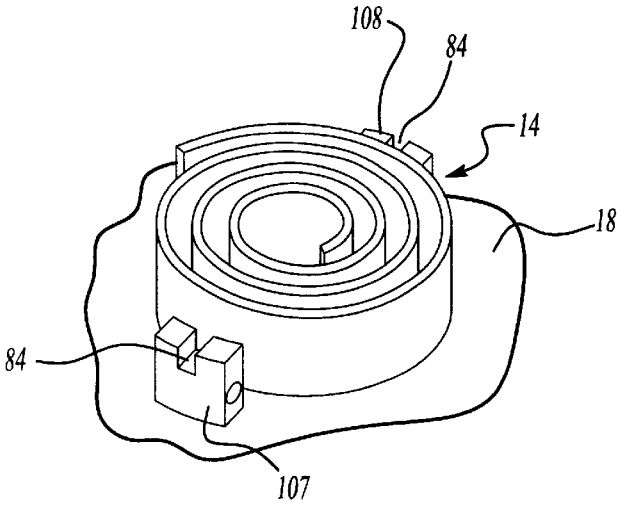
FIG. 4 is an isometric view of the scroll of FIG. 3.
Figure 5:
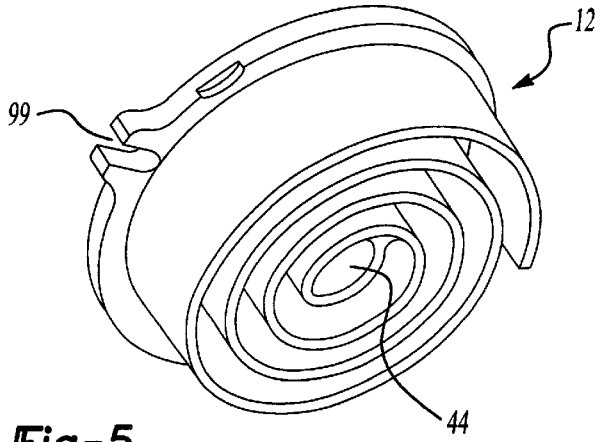
FIG. 5 is an isometric view of a preferred structure for the orbiting scroll of FIG. 1.

In the embodiment shown in FIGS. 1, 2, and 3, the high pressure discharge ports 105 are vented directly into the motor cavity 106 where the gas flows directly onto the motor and cools the same. This structural feature greatly simplifies the scroll assembly. In this embodiment, a highly unique and effective axial compliance mechanism comprises a single gas pressure biasing chamber 89 (shown enlarged for clarity) into which intermediate pressure gas is fed through passage 91. This passage and the pressure face 92 on the free side of the orbiting scroll base are dimensioned to provide a preselected optimum ratio of combined discharge and intermediate gas pressures for achieving the axial compliance. It is noted that the positioning of passage 91 along the scroll base 16 is preselected such that for desired periods of time, albeit extremely short periods, full or nearly full discharge pressure is communicated to chamber 89. The duration of the periods and the exact pressures to which passage 91 and chamber 89 are exposed are engineered into the compressor by proper sizing and placement of this passage in the scroll base. The proper placement of 91, by trial and error or by calculation for a particular compressor can achieve a functional averaging of the high and low pressures produced by the scrolls and thus an axial compliance which is functional, but not excessive such as to damage the wrap edges.

In its preferred form, passage 91 is located through the floor or compression side of the involute and its position is chosen to provide a certain average pressure. In the embodiment where it is purely in the intermediate zone of operation, the developed pressure follows the exponential curve of isentropic compression. The average is approximately halfway between the low and high values. When it is located far enough toward the center of the scroll, the passage is actually open to a pocket that is open to discharge. Since this pressure is basically constant, the average pressure is increased from the average of intermediate only.

The annular face seal 93 in annular groove 94 in housing means 10 maintains the pressure in chamber 89 as the orbiting scroll 12 moves through its orbit. This structure eliminates the need for multiple seals, reduces machining costs and reduces localized thrust forces on the pressure face and thereby essentially eliminates pressure distortion of the scroll base. In this embodiment, the annular resilient seal 93 surrounds and delimits the periphery of the chamber 89 and sealingly contacts the adjacent surfaces of the free side of the base.

With further reference to FIG. 1 , a particularly designed and sized bleed orifice or passage 90 may be provided in the scroll base to place chamber 89 and seal 93 in communication with the oil outlet gap 103 at the top of the crankshaft for oil being pumped upwardly through oil conduit 104. The oil passes from chamber 89 back out thru intermediate passage 91. This orifice will inject discharge pressure oil into the chamber 89 and will raise the average pressure somewhat which can be adjusted by the position of 91. The oil injected through 90 will be pulsed into the vent 91 during the time when the pocket pressure is lower than in chamber 89. The oil injected into the involute will effectively increase the available supply to lubricate the orbiting scroll bearing 44 and the main bearing 46. In addition, it will lubricate the seal 93 and the thrust surface of each scroll and help to seal against leakage in the involutes. This seal is radially inwardly substantially concave as defined by the intermediate portion 100 provided with two oppositely disposed axially flared sides 101, 102, side 102 being in resilient, sliding sealing contact with the free side of the scroll base and the other side 101 being in resilient, sliding sealing contact with the roof of groove 94. The large area of face 92 allows a greatly reduced pressure in chamber 89 and a more flexible seal with less pressure contact with said face, thus markedly increasing the seal life.

Figure 17:
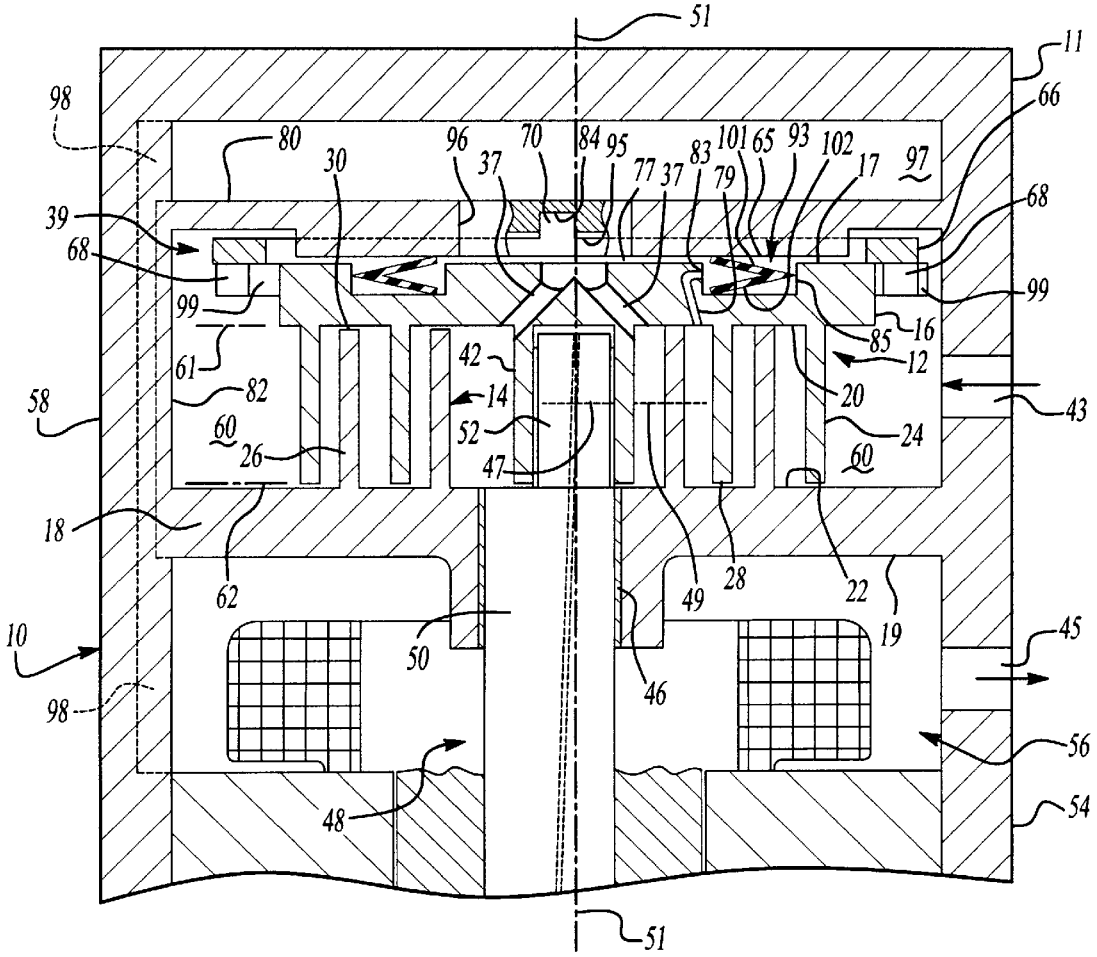
FIG. 17 is a view as in FIG. 12 showing a variation in the structure of the annular face seal and the intermediate gas pressure conduit.

Referring to FIG. 17, the seal 93 of FIG. 1 is also employed in the base means 16 of the orbiting scroll as an alternative to the seal shown in FIG. 12, with its portions numbered the same as in FIG. 1. In this embodiment the conduit 79 is configured slightly different such as to open into the gap between sides 101 and 102 of the seal. The groove 94 of FIG. 1 is simply mirror imaged in base means 16 in FIG. 17 to accommodate seal 93.

The present compressor construction can utilize radial compliance mechanisms such as, for example, as described in U.S. Pat. Nos.: 5,017,107; 5,295,813; 1,906,142; 4,585,403; 4,609,334; 4,743,181; 4,457,675; 4,580,956; and 4,764,096, the disclosures of which concerning radial compliance structures are hereby incorporated herein by reference.

The invention has been described in detail with particular reference to preferred embodiments thereof, but it will be understood that variations and modifications will be effected with the spirit and scope of the invention.

We claim:

1. A scroll compressor comprising:

an orbiting scroll member having a base and a generally spiral wrap extending from said base in a first direction, said orbiting scroll wrap including a bearing hub extending structure, said bearing hub structure being defined by an extension of said wrap, and said bearing hub structure being generally open from an end of said wrap in a direction toward said base, and being closed by said base;

a non-orbiting scroll having a base with a central opening, and a generally spiral wrap extending in a direction opposed to said first direction and interfitting with said spiral wrap of said orbiting scroll; and a shaft adapted for driving said orbiting scroll, said shaft extending through said opening in said non-orbiting scroll, and having an eccentric portion extending into said bearing hub, said eccentric portion not extending through said base of said orbiting scroll.

2. A scroll compressor as recited in claim 1, wherein a central axis of said bearing hub is offset from a central axis of said wrap of said orbiting scroll.

3. A scroll compressor as recited in claim 1, wherein a fluid bias chamber communicating with a pressure fluid is provided by a seal behind said orbiting scroll for biasing said orbiting scroll toward said fixed scroll.

4. A scroll compressor as recited in claim 1, wherein a portion of said base radially outwardly of said hub, and a portion of said base which closes said hub structure defining a common plane.

5. A scroll compressor as recited in claim 1, wherein fluid discharge ports extend through said base of one of said non-orbiting and orbiting scrolls at a location generally adjacent a center of said scroll, and said ports communicating with said compression chambers defined between said non-orbiting and orbiting scroll wraps and extending at a non-zero angle relative to a rotational axis, and from said location where said ports communicate with said compression chambers to a discharge port on an opposed side of said base.

6. A scroll compressor as recited in claim 5, wherein said ports extend through said non-orbiting scroll member, said ports extending to a location radially aligned with said bearing hub such that said discharge port is defined in said first direction just beyond said bearing hub and extending through said fixed scroll.

7. A scroll compressor comprising:

an orbiting scroll member having a base and a generally spiral wrap extending from said base in a first direction, said orbiting scroll wrap including a bearing hub structure, said bearing hub structure being generally open from an axial end of said wrap in a direction toward said base, and being closed by said base;

a non-orbiting scroll having a base with a central opening, and a generally spiral wrap extending in a direction opposed to said first direction and interfitting with said spiral wrap of said orbiting scroll;

a shaft adapted for driving said orbiting scroll, said shaft extending through said opening in said non-orbiting scroll, and having a portion extending into said bearing hub; and at least one fluid discharge port extending through said base of said fixed scroll, said discharge port extending to communicate with said opening, and then extending at an angle non-parallel to a rotational axis of said shaft and through said fixed scroll.

8. A scroll compressor as recited in claim 7, wherein said at least one fluid port extends at an angle through said base of said fixed scroll to communicate with said opening, and said port communicating with said opening at a location directly beyond said bearing hub in said first direction.

9. A scroll compressor comprising:

an orbiting scroll member having a base and a generally spiral wrap extending from said base in a first direction, said orbiting scroll wrap including a bearing hub extending structure, and said bearing hub structure being generally open from an end of said wrap in a direction toward said base, and being closed by said base;

a non-orbiting scroll having a base with a central opening, and a generally spiral wrap extending from solid base in a direction opposed to said first direction and interfitting with said spiral wrap of said orbiting scroll; and a shaft adapted for driving said orbiting scroll, said shaft extending through said opening in said non-orbiting scroll, and having an eccentric portion extending into said bearing hub, an end of said eccentric portion remote from said shaft of said orbiting scroll.

10. A scroll compressor as recited in claim 9, wherein a portion of said base which closes said bearing hub being coplanar with a portion of said base radially outwardly of said bearing hub such that said bearing hub structure ends in approximately the same plane as said wrap.

11. A scroll compressor comprising:

a housing containing an orbiting scroll and a non-orbiting scroll, each of said orbiting and said non-orbiting scrolls having a base formed with a free side and a compression side, and having a wrap extending generally normally from said compression side, each said wrap terminating in an axially outer, substantially planar edge, and having a radially outer, lower pressure refrigerant inlet end and a radially inner, high pressure refrigerant discharge end, said scrolls being mounted within said housing in a mating arrangement about a center axis of said wraps, a guide associated with said wraps for restricting relative motion therebetween to orbital motion which acts to compress gas between said base and adjacent side portions of said wraps, said mating arrangement forming an inlet port adjacent each said inlet end of said wraps, a discharge port formed through one of said bases adjacent said discharge ends of said wraps and communicating therewith, low pressure refrigerant inlet structure formed through said housing and communicating with said inlet port, and high pressure refrigerant discharge outlet formed through said housing and communicating with said discharge port, said orbiting scroll having bearing structure for eliminating a laterally directed tipping moment generally experienced by orbiting scrolls of conventional scroll compressors, said bearing structure including a bearing hub integral with said discharge end of said wrap of said orbiting scroll and extending axially outwardly from said compression side of said orbiting scroll, said hub having a cylindrical bore orientated substantially normally to said compression side of said orbiting scroll for rotatably receiving an eccentric shaft section of a compressor crank shaft, said bore being substantially closed by said base of said orbiting scroll, a bearing having a bore formed axially through said base of said non-orbiting scroll, a crankshaft having an axial section and an eccentric section, said axial section being rotatably mounted in said bore of said bearing means and said eccentric section being rotatably mounted in said bore of said hub, whereby rotation of said crankshaft in cooperation with said guide moves said orbiting scroll through an orbit relative to said non-orbiting scroll to generate compression pockets between said base and said wraps, said pockets progressively increasing in pressure as they move along said wraps from said inlet ends to said discharge ends, wherein a large central area of said free said of said base of said orbiting scroll is co-extensive with a pressure chamber defined and sealed by means of a combination of said free side, a portion of said compressor housing and an annular resilient seal surrounding and delimiting a periphery of said chamber and being in sealing contact with adjacent surfaces of said stationary portion of said housing and said free side, and said chamber being in communication through passages in said scroll compressor with both discharge pressure and intermediate pressure developed by said scrolls.

* * * * *